United States Patent [19]

Plewman

[11] Patent Number: 4,866,584

[45] Date of Patent: Sep. 12, 1989

[54] INDIRECT LUMINAIRE

[75] Inventor: Dale Plewman, Spokane, Wash.

[73] Assignee: Columbia Lighting, Inc., Spokane, Wash.

[21] Appl. No.: 199,751

[22] Filed: May 27, 1988

[51] Int. Cl.[4] ..... F21V 7/12

[52] U.S. Cl. ..... 362/225; 362/241; 362/298; 362/346

[58] Field of Search ..... 362/297, 346, 347, 225, 362/217, 237, 241, 404, 298, 301

[56] References Cited

U.S. PATENT DOCUMENTS

| | | | |
|---|---|---|---|
| D. 274,657 | 7/1985 | Herst et al. | D26/76 |
| 1,820,599 | 8/1931 | Cushing | 362/297 |
| 4,308,573 | 12/1981 | McNamara, Jr. | 362/297 |
| 4,390,930 | 6/1983 | Herst et al. | 362/224 |
| 4,651,260 | 3/1987 | Lasker | 362/281 |
| 4,701,832 | 10/1987 | Lasker | 362/281 |
| 4,729,077 | 3/1988 | Gordin et al | 362/285 |
| 4,748,547 | 5/1988 | Baker | 362/217 |

FOREIGN PATENT DOCUMENTS

| | | | |
|---|---|---|---|
| 830477 | 8/1938 | France | 362/298 |
| 859696 | 6/1940 | France | 362/298 |
| 190264 | 4/1937 | Switzerland | 362/298 |
| 245828 | 8/1947 | Switzerland | 362/297 |
| 483240 | 4/1938 | United Kingdom | 362/297 |

OTHER PUBLICATIONS

Columbia Lighting-Lighting Imprints-1987/1988, pp. 1-40.

Columbia Lighting-Lighting Imprints Technical Data Manual-1/1987, pp. 1-37.

*Primary Examiner*—Ira S. Lazarus
*Assistant Examiner*—Richard R. Cole
*Attorney, Agent, or Firm*—Bielen & Peterson

[57] ABSTRACT

An indirect luminaire mounted adjacent a surface for illuminating the same. The luminaire possesses a first reflector positioned such that the source of light lies intermediate the first reflector and the surface. The first reflector includes an edge portion to cut off light emanating from the source of light. A second reflector is positioned between the source of light and the surface. The second reflector reflects light only toward and along the surface.

10 Claims, 4 Drawing Sheets

INDIRECT LUMINAIRE

BACKGROUND OF THE INVENTION

Direct lighting systems, although most commonly used, possess certain disadvantages in the form of glare and veiling reflections. The lighting industry has developed indirect luminaires which reflect light from a source onto interior surfaces such as walls and ceilings. For example, a product sold under the name Super Tube by Columbia Lighting of Spokane Wash. includes a rotatable reflector that partially surrounds a fluorescent lamp within the luminaire. Although this type of indirect luminaire is highly desirable, there is a tendency to illuminate the ceiling or wall nearest the luminaire to a noticeably greater extent than portions of the wall or ceiling lying a distance from the luminaire. These areas are termed "hot spots". In an attempt to eliminate "hot spots" a second reflector has been placed between the fluorescent lamps and the wall or ceiling. However such a design has not solved the uneven light distribution problem.

U.S. Pat. No. 4,390,930 and Design Pat. No. Des. 274,657 propose an indirect lighting fixture which includes a lens as a extension of the underlying reflector to reduce glare and increase the light distribution. Unfortunately, the use of a lens increases manufacturing costs and necessitates expenditure of labor since the lens requires constant cleaning. In addition, the partial enclosure of the fluorescent lamps inhibits the escape of heat from the lamps and, thus, decreases the operating efficiency of the fluorescent lamps within the luminaire.

An indirect luminaire which solves these problems encountered by the prior art devices would be a great advance in the lighting industry.

SUMMARY OF THE INVENTION

In accordance with the present invention a novel and useful indirect luminaire is provided.

The luminaire of the present invention employs a source of light emanating from an envelope. The source of light is positioned a distance from the surface being illuminated by the indirect luminaire, such as a wall or ceiling, and lies between the surface and a first reflector. The first reflector includes an edge portion which extends toward the surface to a position a selected distance from the surface. Such reflector extension serves to cut off light emanating from the luminaire at a selected angle relative to the surface. Thus, a gap is formed between the first reflector edge portion and the surface. The surface may, in certain cases lie substantially in a first plane. Likewise, the edge portion of the first reflector and the portion of the light source envelope closest to the surface may be substantially coplanar in a second plane. The first plane, in such a case, is essentially parallel to the second plane. The first reflector may include a specular surface or a diffuse surface.

A second concave reflector is also provided in the present invention, being positioned between the envelope and the surface to be illuminated. The second concave reflector receives light from the source, as well as light reflected by the first reflector and projects the same toward and along the surface to be illuminated. The second concave reflector may be constructed with a concave parabolic reflecting surface.

Where the source of light includes a pair of envelopes, e.g.: a two tube or U-shaped fluorescent lamp structure, the second reflector may include first and second concave reflecting surfaces curved oppositely to one another. The first and second concave surfaces of the second reflector may be positioned to receive light only from the first or second lamp sources, respectively. Again, each reflecting surface may be a parabolic surface and may be symmetrical with respect to one another. In addition, the first and second surfaces of the second reflector may be identically positioned relative to each of the lamps.

The luminaire of the present invention may also include a housing having a curved outer surface wherein the gap between the first reflector and the surface to be eliminated interrupts the curved outer surface of the housing.

It may be apparent that a novel and useful indirect luminaire has been described.

It is therefore an object of the present invention to provide an indirect luminaire which eliminates "hot spots" of light adjacent the luminaire and provides a wider distribution of light along a surface to be illuminated.

It is another object of the present invention to provide an indirect luminaire which evenly distributes light along a surface and provides a glare cut off of light directed below the fixture and away from the surface to be illuminated.

Yet another object of the present invention is to provide an indirect luminaire which evenly distributes light along a surface without the use of a lens between a reflector spaced from the surface to be illuminated, yet maintains the appearance of hot possessing such a space.

A further object of the present invention is to provide a indirect luminaire with a reflector positioned between the source of light and the surface to be illuminated which may alter the outward appearance of the luminaire by selecting reflectivity characteristics of the surface of such reflector.

Yet another object of the present invention is to provide an indirect luminaire which operates at a lower temperature than prior art indirect luminaires.

Another object of the present invention is to provide an indirect luminaire which is aesthetically pleasing.

The invention possesses other objects and advantages especially as concerns particular characteristics and features thereof which will become apparent as the specification continues.

Figure 1:
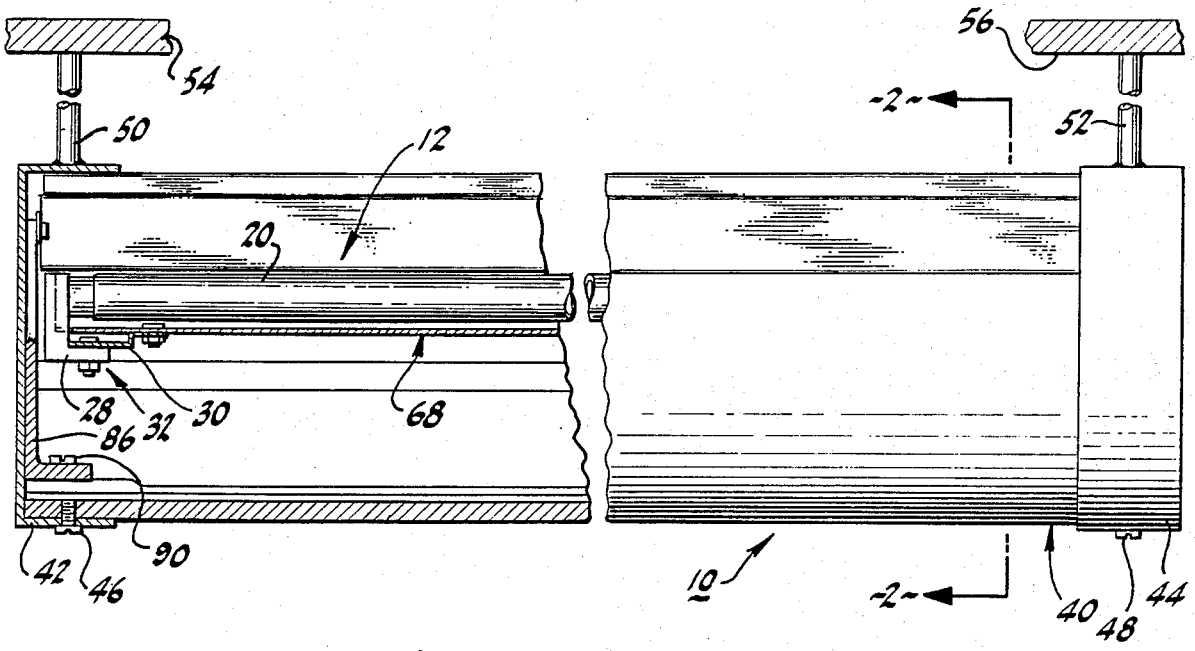
FIG. 1 is a side elevation view of the indirect luminaire of the present invention with a portion broken away in section.

For a better understanding of the invention reference is made to the following detailed description of the preferred embodiments thereof which should be referenced to the hereinabove described drawings.

DESCRIPTION OF PREFERRED EMBODIMENTS

Various aspects of the present invention will evolve from the following description of the preferred embodiments which should be referenced to the above described drawings.

The invention as a whole is shown in the drawings by reference character 10. The indirect luminaire 10 includes as one of its elements a source of light 12 in the form or fluorescent lamps 14 and 16 FIGS. 1 and 2. Fluorescent lamps 14 and 16 are not considered a point source since light emanates from the outer surfaces 18 and 20 of envelopes 22 and 24, respectively. Lamps 14 and 16 are held in sockets 26 and 28 which are fixed to pan 30 by plurality of fasteners 32. Pan 30 fastens to platforms 34 and 36 by plurality of fasteners 38. Platforms 34 and 36 are a part of housing 40 which is in the form of a tube. End caps 42 and 44 are fastened to tube 40 by set screws 46 and 48, FIG. 1. Legs 50 and 52 are welded to caps 42 and 44 and connect to partition member 54 having surface 56 which is to be illuminated by luminaire 10. Bottom rib 58 serves as as a holder for a mounting bolt 60 which connect to ballast support 62. As may be observed on FIGS. 1 and 2, gaps 64 and 66 in the continuity of tube housing 40 to permit light to travel from lamps 14 and 16 to surface 56, which will be discussed in detail hereinafter.

A first reflector 68 is fixed within housing 40 such that lamps 14 and 16 lie between first reflector 68 and surface 56. First reflector 68 includes a reflecting surface 70 which is selected to be specular or diffuse. First reflector 68 includes an edge portion 72 which extends towards surface 56 such that edge or terminus 74 thereof lies towards surface 56 at least as far as the upper edge of outer surfaces 18 and 20 of fluorescent lamp 14 and 16, respectively. Thus, light will not shine directly downwardly from lamps 14 and 16 since edge 74 serves as a light cut-off.

Figure 2:
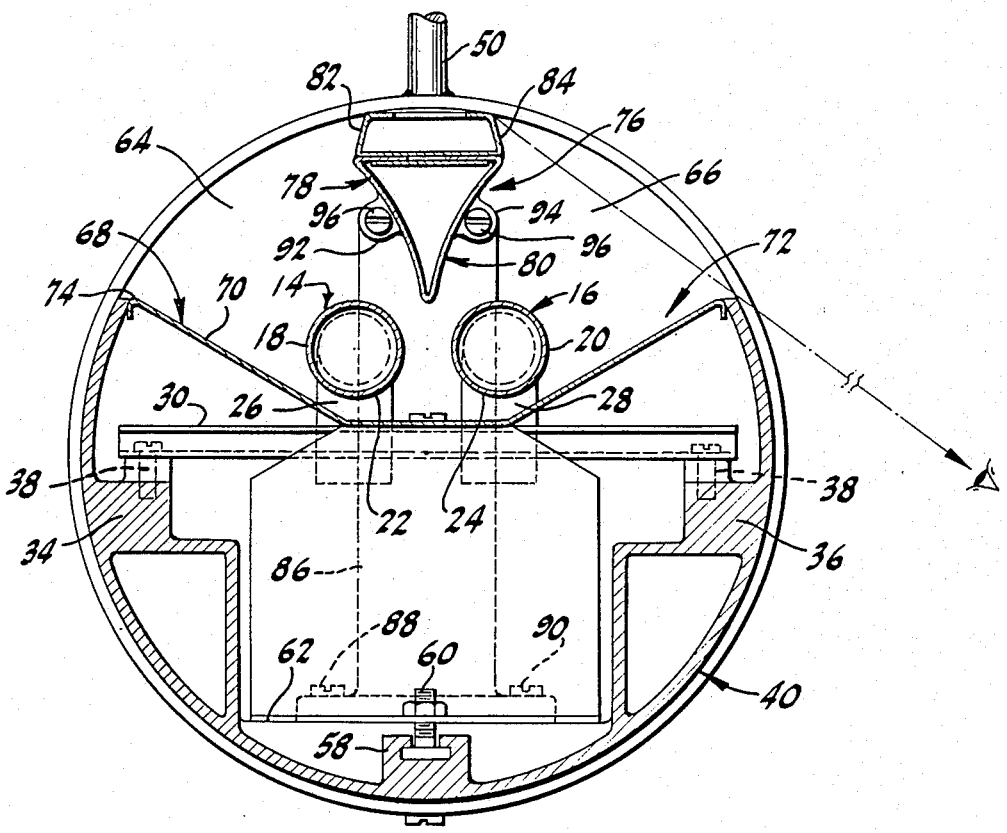
FIG. 2 is a sectional view taken along line 2—2 of FIG. 1.

A second concave reflector 76 is positioned between lamps 14 and 16 and surface 56, FIG. 1. Second reflector includes a first parabolic reflecting surface 78 and a second parabolic reflecting surface 80. Second concave reflector 76 also possesses reflecting surfaces 82 and 84 located closer to surface 56 than reflecting surfaces 78 and 80. Second reflector 76 affixes to bracket 86 fastened to housing 40 via machine screws 88 and 90. Ears 92 and 94 hold reflector 76 to bracket 86 by suitable fastening means 96. It should be noted that the support for first reflector 68, second reflector 76, lamps 14 and 16, on the left side of FIG. 1 is essentially duplicated on the right side of FIG. 1, depicted in elevation.

Figure 3:
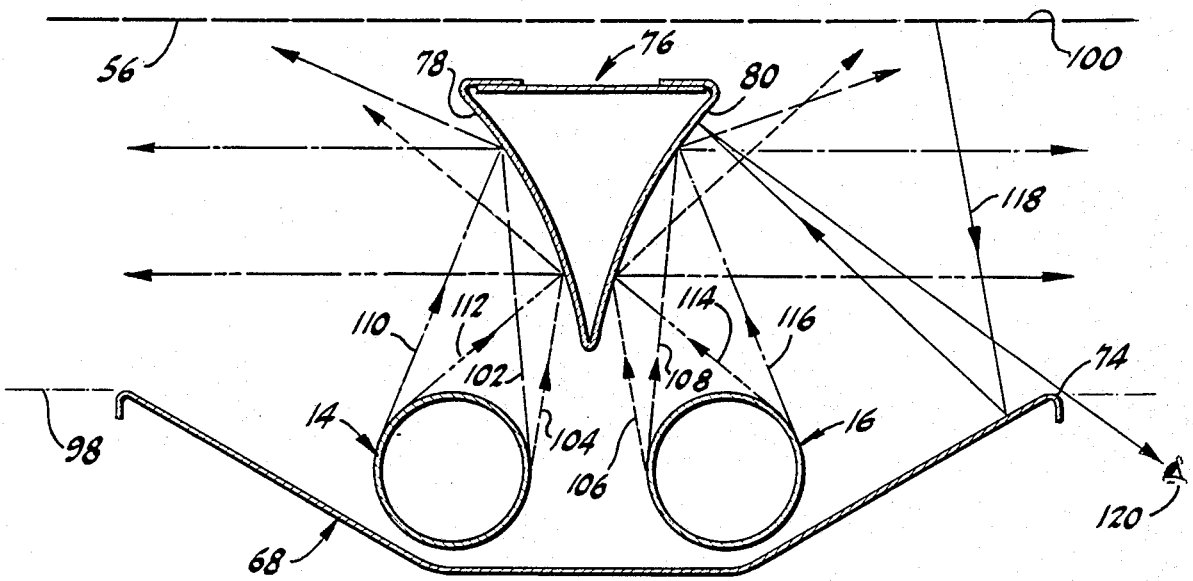
FIG. 3 is a schematic view showing the operation of the upper reflector of the indirect luminaire of the present invention.
Figure 4:
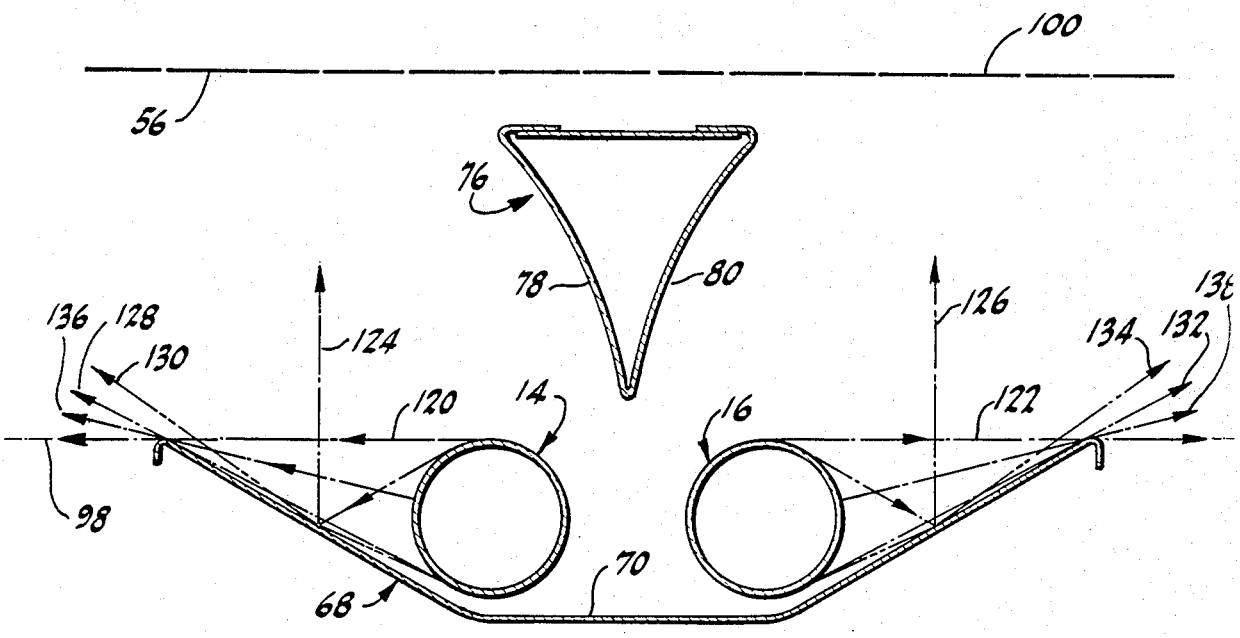
FIG. 4 is a schematic depicting the operation of the lower reflector of the indirect luminaire of the present invention.

Turning to FIGS. 3 and 4 it may be observed that light emanating from lamps 14 and 16 may shine directly on surface 56. In general, terminus or edge 74 of first reflector 68 lies in plane 98 which may be parallel to plane 100 which encompasses surface 56. When surfaces 78 and 80 of second reflector 76 are specular, FIG. 3 depicts typical ray lines of light distribution. It should be noted that light is reflected outwardly from luminaire 10 and along surface 56 according to ray lines 102, 104, 106, and 108. Ray lines 110, 112, 114, and 116 illustrate light reflected onto surface 56 from lamps 14 and 16 by second reflector 76. Ray line 118 represents light reflected from surface 56 originating with light reflecting from reflector 76 or shinning directly from lamp 16. Ray line 118 illustrates that an observer 120 would see the surface 70 of lower reflector 68, be it specular or diffuse. The effect created by the interaction of first and second reflectors 68 and 76 with respect to ray line 118 is that the observer 120 does not perceive the existence of gaps 66 and 68. In other words tubular housing 40 appears to be a full tube although light is shining through gaps 64 and 66 to observer 120, FIG. 2.

With respect to FIG. 4 it may be seen that ray lines 120 and 122 direct light substantially parallel to surface 56; if surface 56 lies within plane 100, i.e. along plane 98. Ray lines 124 and 126 demonstrate that light from lamps 14 and 16 may be directed to surface 56 within the overlying perimeter of reflector 68. Ray lines 128, 130, 132, and 134 show light directed outwardly from luminaire 10 by reflector 68 while ray lines 136 and 138 illustrate light shining directly at a low angle upwardly towards surface 56 from luminaire 10. It should be apparent, that light does not shine directly downwardly from luminaire 10 or is reflected downwardly from luminaire 10 by reflector 68 or reflector 76, without first striking surface 56.

Figure 5:
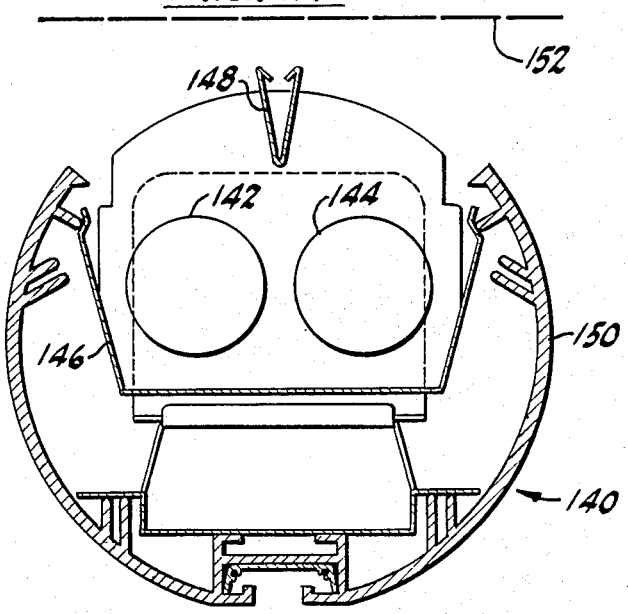
FIG-5 PRIOR ART
FIG. 5 is a schematic view depicting a section of a prior art indirect luminaire having an upper reflector.

Turning to FIG. 5 it may be seen that a prior art luminiare 140 is depicted. Luminaire 140 includes lamps 142 and 144 which are employed in conjunction with reflectors 146 and 148. Housing 150 would not permit light to shine parallel to surface 152 where surface 152 is planar. Also, reflector 148 would cause "hot spots" on surface 152 above luminaire 140.

Figure 6:
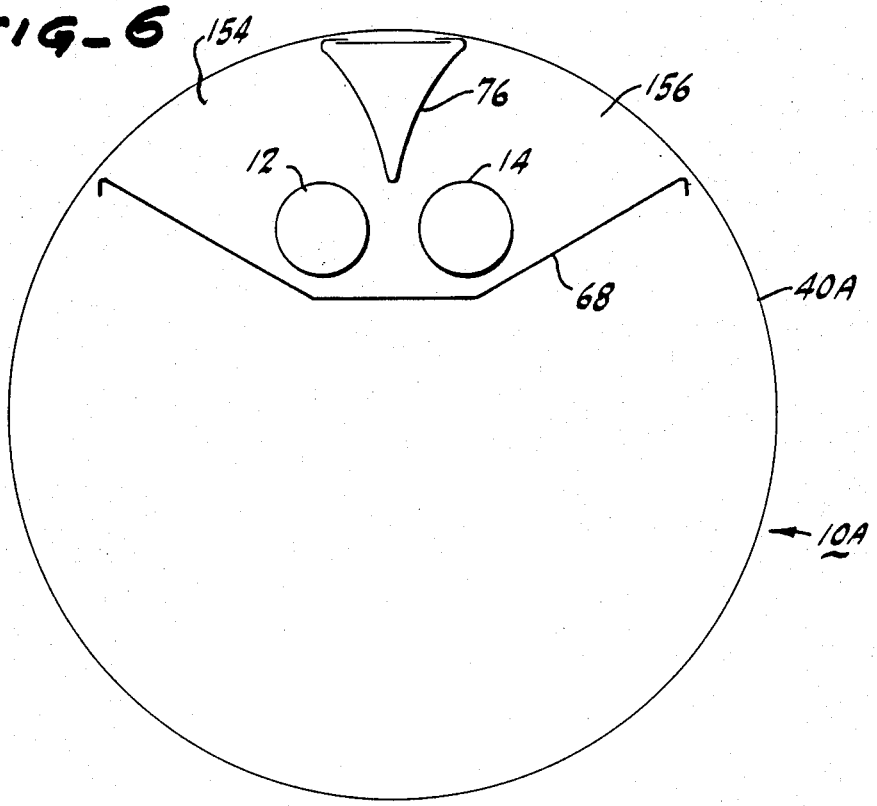
FIG. 6 is a schematic view showing the indirect luminaire of the present invention with a large tubular housing
Figure 7:
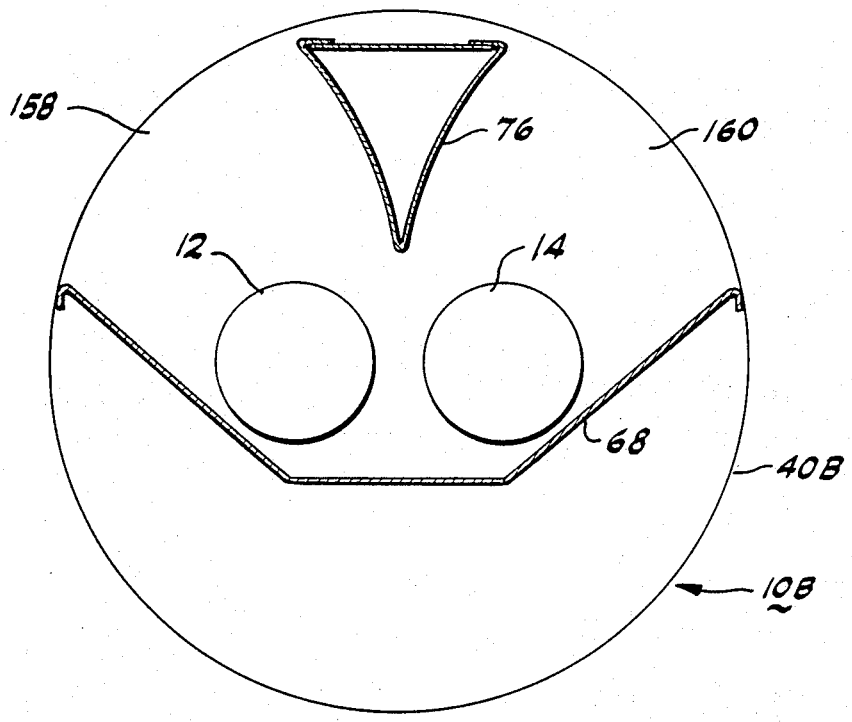
FIG. 7 is a schematic view showing the indirect luminaire of the present invention in a tubular housing smaller than the tubular housing of FIG. 6.

FIG. 6 illustrates, schematically, the scale of the combination of first reflector 68, second reflector 76 and lamps 12 and 14 within a housing 40A. Likewise, FIG. 7 depicts the same elements used in conjunction with a smaller housing 40B. It should be apparent that gaps 154, 156, 158, and 160 permit light to leave luminaires 10A and 1OB in the pattern depicted in FIGS. 3 and 4.

In operation, lamps 12 and 14, FIGS. 1–7, project light which is directed along surface 56 according to the ray lines shown in FIGS. 3 and 4. The luminaire of the present invention eliminates "hot spots" directly above the lamps by directing light outwardly and along surface 56. Also, direct rays from lamps 12 and 14 are not permitted to shine downwardly to an observer 120. Light rays reflecting downward from reflector 76, (ray line 118), have a "soft" appearance if surface 70 of lower reflector 68 is diffuse or surface 54 is diffuse and lower reflector surface 70 is specular. Of course, the characteristics of surface 70 of reflector 68 may be adjusted in color and reflective characteristics.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An indirect luminaire employed in conjunction with a surface, comprising:
   a. a source of light emanating from an axially elongated envelope, said elongated envelope being positioned a selected distance from and axially along the surface;
   b. a first reflector for reflecting light from said source of light, the source of light being further positioned intermediate said first reflector and the surface such that light from said source directly reflects from said first reflector, said first reflector including an edge portion extending toward the surface to a position a selected distance from the surface substantially cut off light emanating from said axially elongated envelope at an angle away from the surface, a gap being formed between said first reflector edge portion and the surface; and c. a second concave reflector having a reflecting surface extending along a curve, said second concave reflector positioned between said envelope and the surface, said second concave reflector positioned to directly receive light emanating from said axially elongated envelope of said light source, said light received by said second concave reflector directly from the source of light being reflected only toward and along the surface, said first and second reflectors being elongated bodies extending along said axially elongated envelope of said source of light, said source of light lying within the curve of said second concave reflector.

2. The indirect luminaire of claim 1 in which said second concave reflector surface includes a concave parabolic, reflecting surface.

3. The indirect luminaire of claim 2 in which the surface lies substantially in a first plane, and said edge portion of said first reflector and the portion of said envelope closest to the surface are substantially coplanar in a second plane, said first plane being essentially parallel to said second plane.

4. The indirect luminaire of claim 1 in which said first reflector includes a specular surface adjacent said envelope.

5. The indirect luminaire of claim 1 in which said first reflector includes a diffuse surface adjacent said envelope.

6. The indirect luminaire of claim 1 which further comprises a housing having a curved outer surface, said gap interrupting said curved outer surface of said housing in the proximity of the surface.

7. The indirect luminaire of claim 1 in which said source of light and said axially elongated envelope are a first source of light and a first axially elongated envelope, and which further comprises a second source of light emanating from a second axially elongated envelope, said second reflector including first and second concave reflecting surfaces each extending along a curved line such that said first and second reflectors are oppositely concave relative to one another, said first concave reflecting surface of said second reflector receiving light directly only from said first light source, said second concave reflecting surface of said second reflector receiving light directly only said second light source, said first and second light sources being positioned intermediate said first reflector and the surface, such that light from said first and second sources directly reflect from said second reflector.

8. The indirect luminaire of claim 7 in which said first and second concave reflecting surfaces of said second reflector are symmetrical.

9. The indirect luminaire of claim 7 in which said first and second concave reflecting surfaces of said second reflector are parabolic.

10. The indirect luminaire of claim 7 in which said first concave reflecting surface of said second reflector is oriented relative to said first light source similarly to the orientation of said second concave reflecting surface of said second reflector relative to said second light source.

* * * * *